US006959454B2

(12) United States Patent
DeWinter

(10) Patent No.: US 6,959,454 B2
(45) Date of Patent: Nov. 1, 2005

(54) STRUCTURE WITH EXTENDABLE LEAVES

(76) Inventor: David S. DeWinter, 3240 N. Hawkins Rd., Luther, MI (US) 49656-9371

( * ) Notice: Subject to any disclaimer, the term of this patent is extended or adjusted under 35 U.S.C. 154(b) by 116 days.

(21) Appl. No.: 10/366,904

(22) Filed: Feb. 14, 2003

(65) Prior Publication Data

US 2004/0158912 A1 Aug. 19, 2004

(51) Int. Cl.[7] ..... A42B 1/00
(52) U.S. Cl. ..... 2/195.1; 2/12
(58) Field of Search ..... 2/209.12, 10, 12, 2/195.1

(56) References Cited

U.S. PATENT DOCUMENTS

| | | | | |
|---|---|---|---|---|
| 340,176 | A | 4/1886 | Wardwell, Jr. | |
| 566,326 | A | 8/1896 | Kirshner | |
| 2,179,719 | A | 11/1939 | Goskey | |
| 3,680,942 | A | 8/1972 | Davis | |
| 4,607,397 | A * | 8/1986 | Laxo | 2/410 |
| 4,793,006 | A | 12/1988 | Dawson | |
| 5,075,898 | A * | 12/1991 | Bedient | 2/10 |
| 5,197,150 | A | 3/1993 | Bedient | |
| 5,425,313 | A | 6/1995 | Rowan | |
| 5,544,361 | A * | 8/1996 | Fine et al. | 2/10 |
| 5,621,915 | A | 4/1997 | Schneider et al. | |
| 5,689,830 | A | 11/1997 | Pflum | |
| 5,839,125 | A | 11/1998 | Chen | |
| 5,901,371 | A * | 5/1999 | Lee | 2/10 |
| 6,473,907 | B1 * | 11/2002 | Harwood | 2/209.13 |

* cited by examiner

*Primary Examiner*—Katherine M. Moran
(74) *Attorney, Agent, or Firm*—Price, Heneveld, Cooper, DeWitt & Litton LLP

(57) ABSTRACT

A structure with extensible/retractable panels, which provides variable surface area for items such as headgear brims, furniture tops, etc., includes a first panel, a second panel pivotally mounted to the first panel, and a third panel pivotally mounted to the first panel. The second and third panels are rotatable from a retracted position in which the second and third panels are positioned underneath the first panel, and a deployed position in which the second and third panels extend beyond both the length and width of the first panel.

8 Claims, 4 Drawing Sheets

STRUCTURE WITH EXTENDABLE LEAVES

FIELD OF THE INVENTION

This invention relates to a structure with extensible/retractable leaves, to provide a variable surface area for supporting, covering or shading purposes.

BACKGROUND OF THE INVENTION

Although headgear having a retractable visor slideably mounted under a fixed brim or visor, or a releasably attachable brim or visor extension fastenable to a fixed brim or visor are well known, these structures are generally only capable of extending either the length or the width of the visor, not both the length and width. For example, U.S. Pat. No. 5,621,915 discloses a removable cap visor extension that is attachable to a visor of a cap or hat either by sliding the visor through slots in an extension unit or by clasping the extension unit onto a visor of a cap with fasteners. The removable cap visor is not retractable, but instead is either attached or not attached to the cap or hat. Accordingly, the disclosed removable cap visor does not allow continuously variable adjustment of the length and does not allow any adjustment of the width of the visor.

U.S. Pat. No. 6,202,218 discloses a hat having an extensible visor which is inserted into a slot of a fixed visor or brim to facilitate variable adjustment of the length of the visor. However, the disclosed extensible visor does not permit variable adjustment of both the length and width of the visor.

U.S. Pat. No. 5,689,830 discloses a visor for use as a brim component for a hat or cap. The brim is both retractable and extendable, and is also swivelable and rotatable around the circumference of the head of the wearer. However, the visor is only swivelable with respect to the hat, and does not allow pivoting of the extensions with respect to the fixed brim to adjust the width of the visor.

U.S. Pat. No. 5,901,371 discloses a cap with adjustable side visors disposed on opposite sides of a main fixed visor. Each side visor has a flap pivotally mounted thereto which is moveable from a first position disposed within the respective side visor to a second position extending downwardly therefrom to vary the shading desired by the user. However, the flaps do not provide a visor extension that achieves variable adjustment of both the length and width of the visor.

Other patents that disclose caps having an extensible visor that allows adjustment of the length of the visor, but not the width of the visor, include U.S. Pat. Nos. 4,793,006; 5,075,898; 5,197,150 and 5,839,125. These patents all recognize the desirability of being able to adjust the length of a visor, whereas U.S. Pat. No. 5,901,371 recognizes the desirability of being able to adjust the length of a side visor portion to provide more shading on one or both sides of the cap. However, none of these patents acknowledge the desirability of being able to adjust both the length and width of a visor, and none of these patents suggest a suitable structure for achieving adjustment of both the length and width of a visor.

The art relating to structures having a support surface with an area that is adjustable is perhaps best exemplified by the furniture art. Heretofore, most tables, desks, and other articles of furniture having a variable area support surface generally utilized a removable leaf, or a leaf extension that is either slideably mounted, or pivotally mounted to the furniture for rotation from a vertical orientation to a horizontal orientation. These extensible structures have certain disadvantages. For example, removable leaves do not allow variable adjustment of the surface area on which items may be supported on the table or other article of furniture, and must generally be transported to and from a storage location when a larger or smaller surface area is desired. Leaves that are either pivotally or slideably connected to the article of furniture eliminate the need for storage and transportation. However, the slideably mounted leaves only allow adjustment of either the length or width of the support surface of an article of furniture, not both the length and width. Similarly, the leaves that are rotatably mounted to the support surface of an article of furniture are typically rotatable through an axis substantially within the plane of the support surface of the article of furniture from a vertical to a horizontal orientation, and therefore only allow expansion of either the length or width of the table, not both, and do not provide the option of variable adjustment of the support surface area.

Similar structures used to supplement the surface area in other environments typically suffer from the same disadvantages of furniture having conventional extensible/retractable leaves.

SUMMARY OF THE INVENTION

The invention provides a structure with extensible/retractable leaves that allow variable adjustment of the surface area of an object. The structure includes a first panel, and second and third panels each pivotally mounted to the first panel, the second and third panels being pivotable into any position between a first position in which superposition of the second and third panels is minimized and a second position in which superposition of the second and third panels is maximized.

In one aspect of the invention, the structure is utilized to provide a hat or cap brim that is extensible in both the width and length direction of the brim to provide variable shading as desired, depending on conditions and the activities in which the wearer is engaged.

In accordance with another aspect of the invention, the structure with extensible/retractable leaves is used to provide an article of furniture having a surface area that can be expanded or retracted in both the length and width direction as desired.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
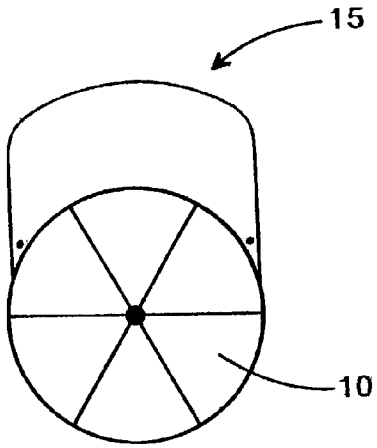
FIG. 1 is a top view of a cap having a brim with extensible/retractable leaves in accordance with the invention, with the leaves shown in a fully retracted position.
Figure 3:
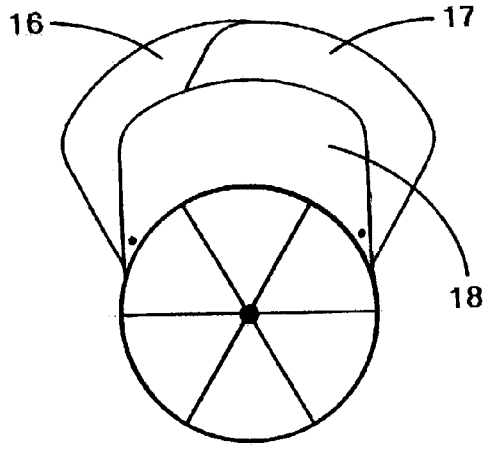
FIG. 3 is a top view of the cap shown in FIGS. 1 and 2, with the extensible/retractable leaves shown in a fully extended position.

Shown in FIGS. 1–9 is a cap 10 having a brim 15 with extensible/retractable leaves 16, 17, each of which is pivotally mounted to a main brim member 18. Main brim member 18 is typically fixed to cap 10 in a conventional manner. Extensible/retractable leaves 16, 17 are pivotally attached to opposite ends of main brim member 18 and are rotatable around pivot pins 21, 20 to allow the effective area of the brim to be expanded in both the length and width directions.

Figure 2:
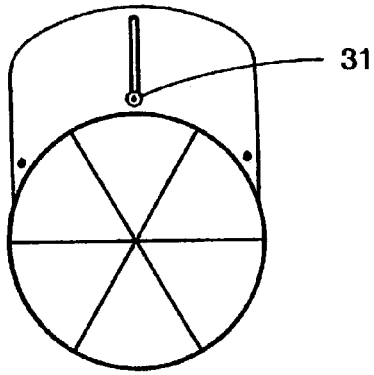
FIG. 2 is a bottom view of the cap shown in FIG. 1, with the extensible/retractable leaves in the fully retracted position.
Figure 4:
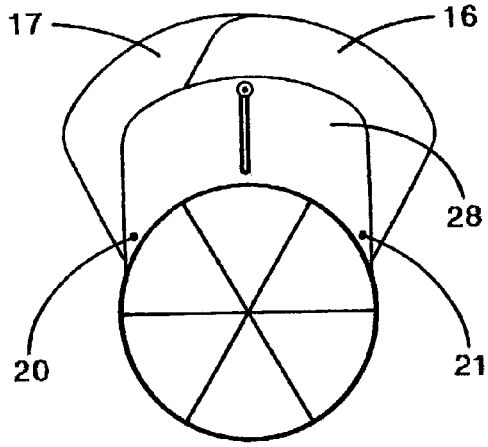
FIG. 4 is a bottom view of the cap shown in FIGS. 1–3, with the extensible/retractable leaves in a fully extended position.
Figure 5:
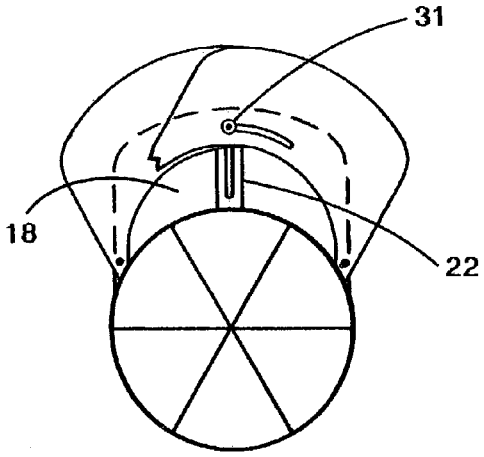
FIG. 5 is a bottom view of the cap shown in FIGS. 1–4, with a portion of the brim removed to illustrate details of the extensible/retractable leaves of the brim.
Figure 6:
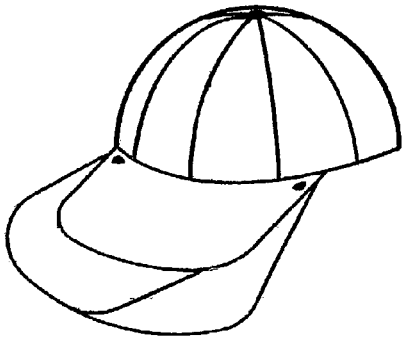
FIG. 6 is a perspective view of the cap shown in FIGS. 1–5, with the extensible/retractable leaves in a fully extended position.
Figure 7:
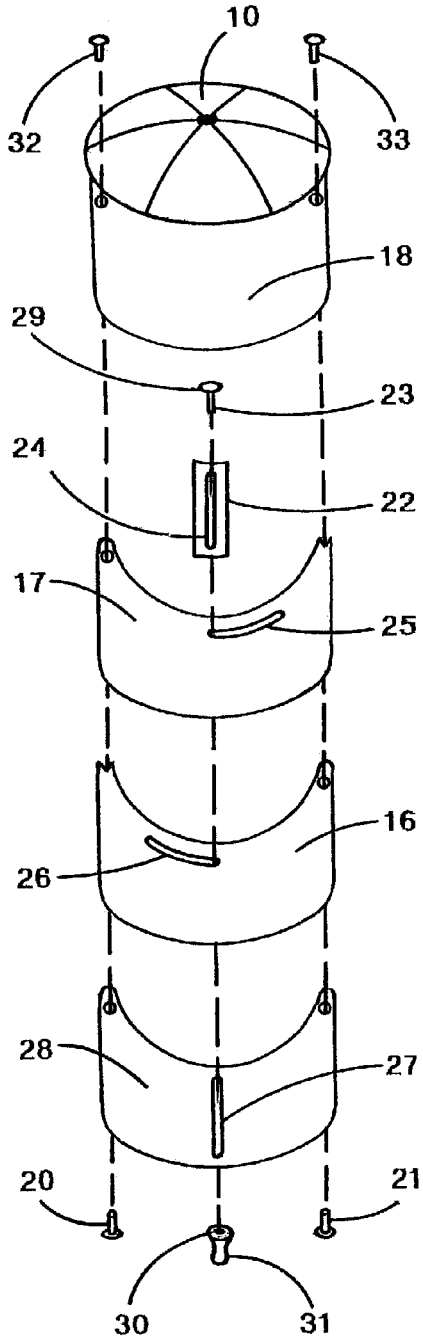
FIG. 7 is an exploded perspective of the cap shown in FIGS. 1–6, which illustrates the manner in which the various components of the cap are assembled.
Figure 8:
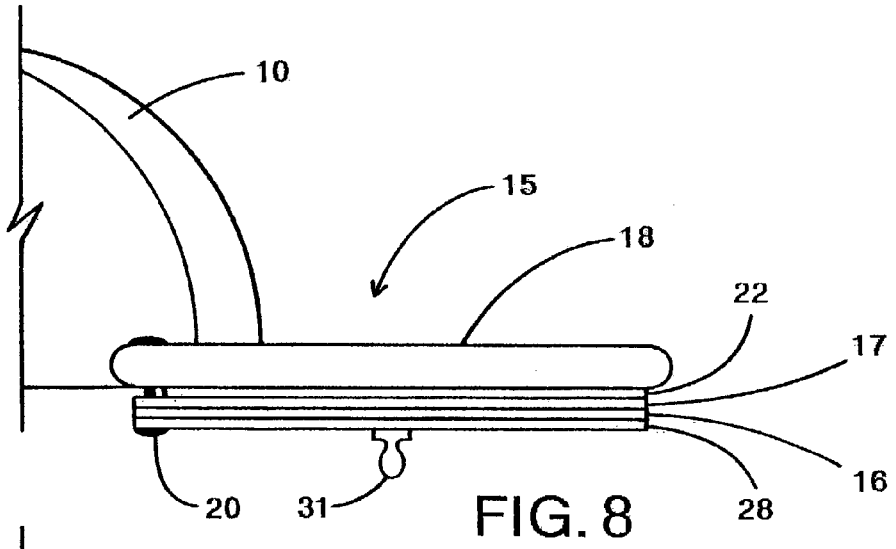
FIG. 8 is a side view of the cap shown in FIGS. 1–7, with the extensible/retractable leaves in a fully retracted position.
Figure 9:
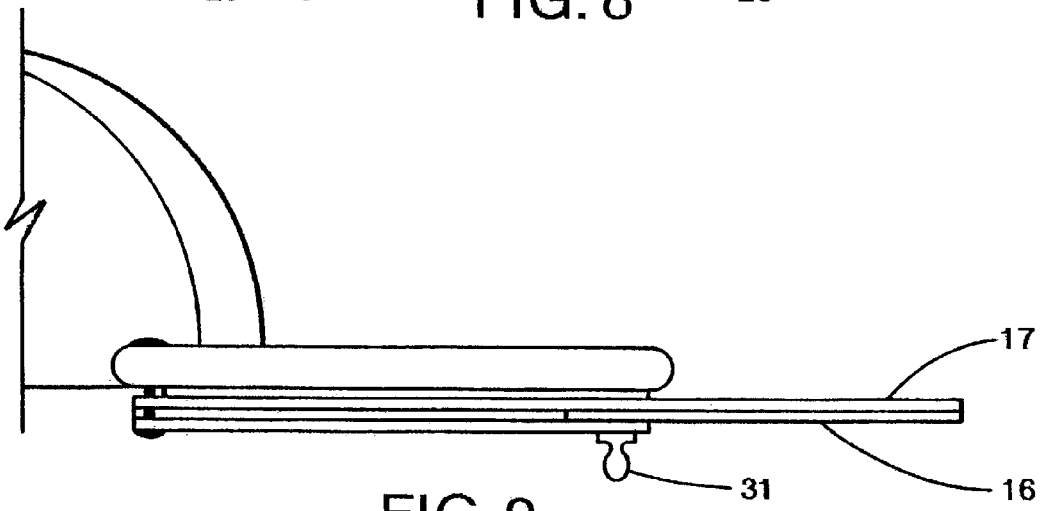
FIG. 9 is a side view of the cap shown in FIGS. 1–8 with the extensible/retractable leaves of the brim in a fully extended position.

In the fully retracted position shown in FIGS. 1, 2 and 8, extensible/retractable leaves 16, 17 are completely covered and generally concealed by main brim member 18 and secondary guide member 28, whereby the effective surface area of adjustable brim 15 is equal to the area of main brim member 18. Each of the extensible/retractable leaves 16, 17 are pivotable into any position between a first position in which superposition of the extensible/retractable leaves with main brim member 18 is minimized (i.e., extension and surface area are maximized) as shown for example in FIGS. 3–6, and a second position in which superposition of extensible/retractable leaves 16, 17 with main brim member 18 is maximized (i.e., leaves 16 and 17 are fully retracted to minimize surface area of brim 15) as shown in FIGS. 1 and 2. Movement of leaves 16 and 17 can be either independent or dependent. However, in the illustrated embodiment movement of extensible/retractable leaves 16 and 17 is coordinated (i.e., structure is provided to cause leaves 16 and 17 to be extended and retracted together). This mechanism includes a guide 22 secured to the underside of main brim member 18, a pin 23 that extends through an elongate linear slot 24 through guide 22, an elongate arcuate slot 25 through leaf 17, an elongate arcuate slot 26 through leaf 16, and an elongate slot 27 through a secondary guide member 28. Pin 23 includes a head section 29 which is wider than slot 24, and is therefore retained between main brim member 18 and guide 22. Leaves 16, 17 and secondary guide member 28 are sandwiched between guide 22 and a flange portion 30 of an actuator 31 fastened to the shank portion of pin 23. In the illustrated embodiment, fasteners 32 and 33 cooperate with pins 20 and 21 respectively to hold the various brim components 16, 17, 18 and 28 together in a layered relationship. In this illustrated embodiment, a shank portion of fasteners 32 and 33 are received in axial bores extending through pins 20 and 21 respectively. Fasteners 32 and 33 may be secured to pins 20 and 21 respectively by means of an interference fit, frictional engagement, adhesives, or various other means. Various alternative means for assembling the components of the brim may also be utilized, provided that each of the extensible/retractable leaves 16 and 17 may be rotated with respect to main brim member 18 to supplement the effective area of brim 15 in both the length and width directions.

The effective area of brim 15 may be expanded by grasping actuator 31 and pushing outwardly toward the edge of the brim 15 in a direction coinciding with the longitudinal direction of slot 27. This causes pin 23 attached to actuator 31 to engage the outer edge of slots 26 and 25 of extensible/retractable leaves 16 and 17 respectively, whereby leaf 16 is rotated outwardly around pin 21 and extensible/retractable leaf 17 is rotated outwardly around pin 20. Leaves 16 and 17 may be retracted by moving actuator 31 in an opposite direction away from the edge of brim 15, or by pushing inwardly on the outward edges of extended leaves 16 and 17.

In the illustrated embodiment, leaves 16 and 17 are essentially mirror images of each other. This, along with slots 25 and 26, guide slot 24, and pin 23, and optional guide slot 27 ensure that brim components 16 and 17 are extended equally to provide brim symmetry. Such symmetry is generally desired for aesthetic reasons. However, the slots and guides are not essential to achieving a brim structure which may be expanded in both the length and width directions.

Figure 10:
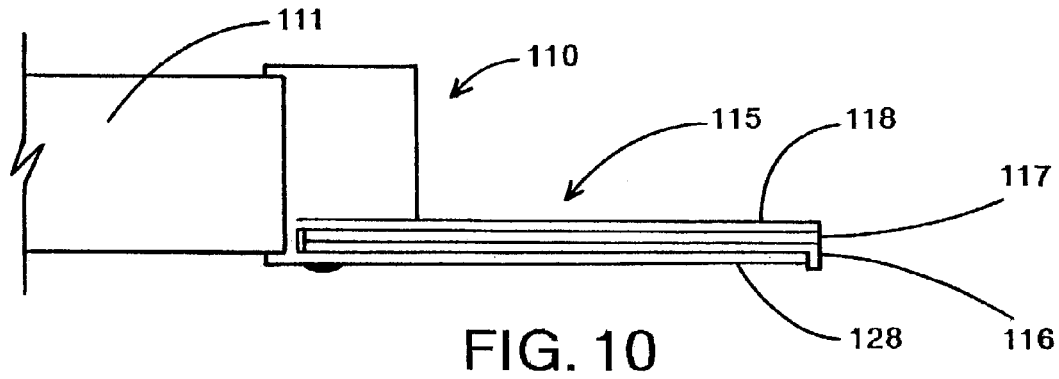
FIG. 10 is a side view of a headgear comprising a headband and a brim similar to the brim on the cap of FIGS. 1–9.

Shown in FIG. 10 is an alternative embodiment of the invention in which the structure with extensible/retractable leaves described above with respect to FIGS. 1–9 is utilized with a headband, rather than with a cap. Headgear 110 includes a headband 111 attached to a structure with extensible/retractable leaves as generally described above. The extensible/retractable leaves structure includes a main brim 118, a first extensible/retractable leaf 116, a second extensible/retractable leaf 117, and a guide member 128. Brim structure 115 of headgear 110 may be similar to the brim structure 15 described above with respect to the embodiment illustrated in FIGS. 1–9. Thus, FIG. 10 illustrates that the structure with extensible/retractable leaves may be utilized with any of a variety of different hats, caps, headbands, and various other headgear.

Figure 11:
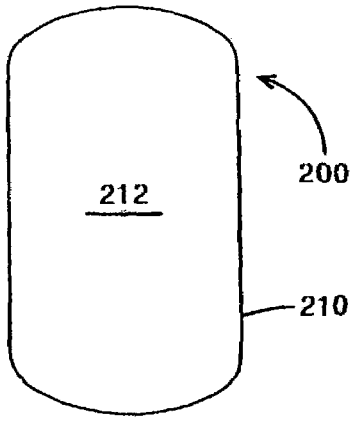
FIG. 11 is a top view of a table utilizing the structure with extensible/retractable leaves to provide variable surface area.
Figure 12:
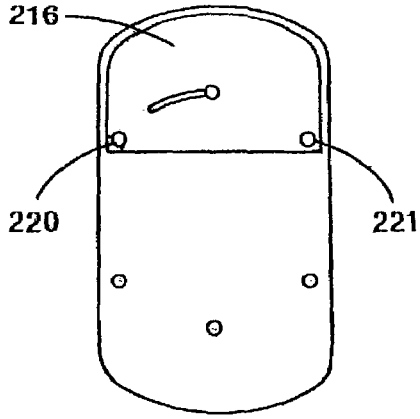
FIG. 12 is a bottom view of the table shown in FIG. 11.
Figure 13:
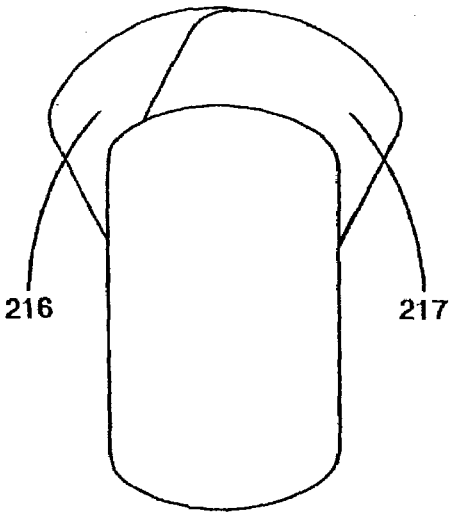
FIG. 13 is a top view of the table shown in FIG. 11, with the extensible/retractable leaves in a fully extended position.
Figure 14:
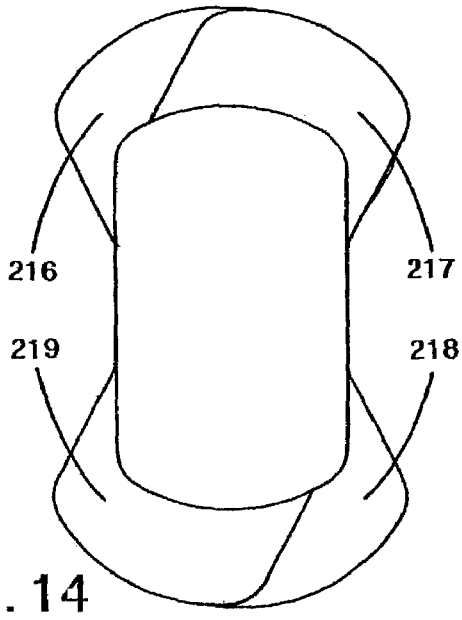
FIG. 14 is a top view of a table with extensible/retractable leaves on opposite ends of the table in a fully deployed position.
Figure 15:
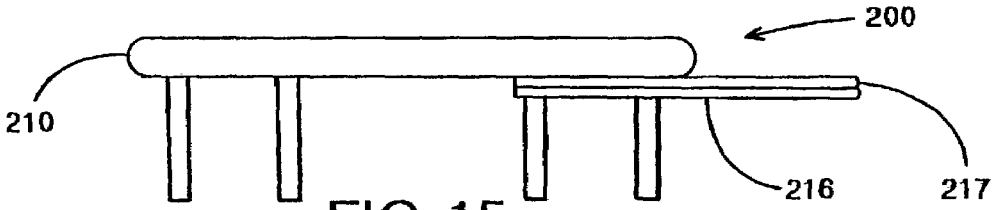
FIG. 15 is a side elevational view of the table shown in FIGS. 11–13, with the extensible/retractable leaves in a fully extended position.

Shown in FIGS. 11–14 is an article of furniture 200, such as a desk or table, having a first panel 210 which provides a horizontal support surface or work surface 212. A second panel 216 and a third 217 are each pivotally mounted onto the underside of first panel 210, whereby they may be rotated between a retracted position as shown in FIGS. 11 and 12, wherein panels 216 and 217 are entirely superposed beneath first panel 210 (i.e., a position in which superposition is maximized), and a second position in which panels or leaves 216 and 217 are rotated around pivot pins 221 and 220 respectively into a position in which superposition of the second and third panels 216 and 217 is substantially reduced, whereby the effective area of support surface 212 is increased in both the length and width directions. As illustrated in FIG. 15, extensible/retractable leaves 216 and 217 may be provided at one end of first panel 210, and additional extensible/retractable leaves 218 and 219 may be provided at an opposite end of first panel 210.

As with the headgear illustrated in FIGS. 1–10, articles of furniture and other structures employing the extensible/retractable leaves may be provided with a means for deploying leaves 216 and 217 in a symmetrical fashion. This means may be generally similar to those described for extensible/retractable visor 15.

In addition to headgear and articles of furniture, the disclosed structure with extensible/retractable leaves may be utilized for a variety of other purposes, such as for various platforms, trays, etc.

The actuator used with the structure (e.g., actuator 31) may be directly or indirectly connected to the extensible/retractable leaves or panels, and can be slideably, rotationally or otherwise manipulated to effect movement of the leaves or panels. The actuators may or may not be lockable. Additionally, the pivot pins can be suitably configured to function as actuators. Actuators can be situated at various locations on the visor assembly. When only one fixed visor panel is used, it can be located above or below the visor extensions. Fixed and rotatable visor panels can be made from cardboard, fabric, plastic, wood or any other suitable material.

The structures of this invention may employ more than two extensible/retractable panels which may be deployed and retracted in a manner similar to that of the illustrated embodiments. Accordingly, the claims are to be interpreted to require at least two extensible/retractable panels and encompass structures having three or more extensible/retractable panels.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A headgear having a brim structure with extensible/retractable panels to provide variable surface area, comprising:

headgear to which the structure is attached to provide a brim with a variably adjustable length and width;

the structure including a first panel, a second panel pivotally mounted to the first panel, a third panel pivotally mounted to the first panel, the second and third panels being movable between a first position in which superposition of the second panel and third panel with the first panel is minimized, and a second position in which superposition of the second panel and third panel with the first panel is maximized; and a mechanism including a guide on the first panel, elongated slots in each of the second and third panels, and a pin extending through the elongated slots and engaging the guide, whereby movement of the pin in one direction causes extension of both panels simultaneously and movement of the pin in a second opposite direction causes retraction of both panels simultaneously.

2. A headgear having an extensible/retractable visor structure, comprising:

a headgear; and a visor structure including a first visor panel having an inner edge fixed to the headgear and an outer exposed edge, a second visor panel pivotally mounted to the first visor panel by a first pivot, a third visor panel pivotally mounted to the first visor panel by a second pivot, the second and third visor panels being pivotable from a retracted position, in which the second and third visor panels are arranged in at least a partially overlapping layered relationship, to an extended position in which the second and third visor panels extend beyond the outer exposed edge of the first visor panel.

3. The headgear of claim 2, further comprising a mechanism that causes the second and third panels to be extended and retracted in relation to one another.

4. A structure with extensible/retractable panels to provide variable surface area, comprising:

a first panel having an outer exposed edge, a second panel pivotally mounted to the first panel by a first pivot, a third panel pivotally mounted to the first panel by a second pivot, the second and third panels being pivotable from a retracted position in which the second and third panels are arranged in at least a partially overlapping layered relationship, to an extended position in which the second and third panels extend beyond the outer exposed edge of the first panel.

5. The structure of claim 4, further comprising headgear to which the structure is attached to provide a brim with a variably adjustable length and width.

6. The structure of claim 4, further comprising an article of furniture to which the structure is attached to provide a support surface having a variably adjustable area.

7. The structure of claim 4, further comprising a mechanism that causes the second and third panels to be extended and retracted in relation to one another.

8. The structure of claim 4, wherein the mechanism includes a guide on the first panel, elongated slots in each of the second and third panels, and a pin extending through the elongated slots and engaging the guide, whereby movement of the pin in one direction causes extension of both panels simultaneously and movement of the pin in a second opposite direction causes retraction of both panels simultaneously.

* * * * *